US006887313B2

(12) United States Patent
Russ

(10) Patent No.: US 6,887,313 B2
(45) Date of Patent: May 3, 2005

(54) IN-LINE MARKING SYSTEM

(75) Inventor: Wray Russ, Brentwood, CA (US)

(73) Assignee: Microboards Technology, LLC, Chanhassen, MN (US)

( * ) Notice: Subject to any disclaimer, the term of this patent is extended or adjusted under 35 U.S.C. 154(b) by 0 days.

(21) Appl. No.: 10/272,325

(22) Filed: Oct. 15, 2002

(65) Prior Publication Data

US 2004/0069222 A1 Apr. 15, 2004

(51) Int. Cl.[7] ..... B05B 13/02

(52) U.S. Cl. ..... 118/324; 118/46; 427/424; 347/4

(58) Field of Search ..... 347/104, 2, 4; 118/324, 46; 427/424

(56) References Cited

U.S. PATENT DOCUMENTS

| | | | | |
|---|---|---|---|---|
| 2,296,013 A | | 9/1942 | Bell | |
| 2,304,437 A | | 12/1942 | Bell | |
| 4,195,961 A | | 4/1980 | Waiblinger | |
| 4,336,275 A | * | 6/1982 | Scholes | 427/477 |
| 4,504,186 A | | 3/1985 | Richards | |
| 4,595,481 A | | 6/1986 | Allen et al. | |
| 4,735,540 A | | 4/1988 | Allen et al. | |
| 4,921,397 A | | 5/1990 | Watanabe | |
| 5,123,005 A | | 6/1992 | Kurosu | |
| 5,210,729 A | | 5/1993 | Schmidt et al. | |
| 5,317,337 A | | 5/1994 | Ewaldt | |
| 5,322,188 A | | 6/1994 | Dodaro | |
| 5,397,214 A | | 3/1995 | Cheung | |
| 5,520,106 A | | 5/1996 | Karlyn et al. | |
| 5,520,107 A | | 5/1996 | Airoldi | |
| 5,537,376 A | | 7/1996 | Ikuma | |
| 5,721,715 A | | 2/1998 | Mitani et al. | |
| 5,734,629 A | | 3/1998 | Lee et al. | |
| 5,757,407 A | * | 5/1998 | Rezanka | 347/102 |
| 5,758,038 A | * | 5/1998 | Itoh et al. | 358/1.9 |
| 5,822,162 A | | 10/1998 | Tannert | |
| 5,846,005 A | | 12/1998 | Britz et al. | |
| 5,857,710 A | | 1/1999 | Leising et al. | |
| 5,865,114 A | | 2/1999 | Averill et al. | |
| 5,912,680 A | | 6/1999 | Uchida et al. | |
| 5,914,918 A | | 6/1999 | Lee et al. | |
| 5,927,208 A | | 7/1999 | Hagstrom et al. | |
| 5,984,295 A | | 11/1999 | Britz | |
| 6,075,758 A | | 6/2000 | Wu | |
| 6,123,020 A | | 9/2000 | Wolfer et al. | |
| 6,134,213 A | | 10/2000 | Suzuki et al. | |
| 6,135,316 A | | 10/2000 | Wolfer et al. | |
| 6,147,960 A | | 11/2000 | Wolfer et al. | |
| 6,148,722 A | | 11/2000 | Hagstrom | |
| 6,213,457 B1 | | 4/2001 | Schlough | |
| 6,302,601 B1 | | 10/2001 | Hagstrom et al. | |
| 6,332,680 B1 | | 12/2001 | Ozawa | |
| 6,354,502 B1 | | 3/2002 | Hagstrom et al. | |

(Continued)

FOREIGN PATENT DOCUMENTS

EP 0 799 710 10/1997

OTHER PUBLICATIONS

EMEDIA Professional, "Buyers Guide to CD Duplication Systems—40 New towers, autoloaders, jukeboxes", Nov. 1997.

*Primary Examiner*—Chris Fiorilla
*Assistant Examiner*—Michelle Acevedo Lazor
(74) *Attorney, Agent, or Firm*—Burns, Doane, Swecker & Mathis, LLP

(57) ABSTRACT

An in-line marking system for marking indicia on a markable medium. The system includes a dispenser for dispensing a markable medium onto a conveyor belt assembly. The conveyor belt assembly conveys the medium from a first position to a second position, wherein a marking device located between the first position and the second position marks indicia on the medium. The conveyor belt assembly has a plurality of belts forming a conveyor surface.

43 Claims, 13 Drawing Sheets

U.S. PATENT DOCUMENTS 6,447,181 B1 9/2002 Hagstrom et al.
6,474,805 B2 * 11/2002 Dante et al. ..... 347/102
6,499,841 B1 * 12/2002 Uchida et al. ..... 347/104
2002/0012036 A1 1/2002 Dante et al.
2002/0021921 A1 2/2002 Akema et al.
2002/0092735 A1 7/2002 Greive et al.

* cited by examiner

IN-LINE MARKING SYSTEM

FIELD OF THE INVENTION

The invention generally relates to a marking system and method for marking indicia on a markable medium, and more particularly to an in-line marking system for marking indicia on mediums such as compact disks, DVD's, computer chips, or any medium having a markable or printable surface.

BACKGROUND OF THE INVENTION AND BRIEF DESCRIPTION OF THE RELATED ART

The marking of mediums reflects the content of the medium and allows the dissemination of information wherein the end user can identify the subject matter located within the medium. In addition, logos, trademarks, text, graphics, and bar codes can be added to the medium for marketing, sales and cataloging of information.

The printing processes for printing information and graphics on the surface of a medium including plastic disks or compact disks, generally include a silk screening printing process, a printer utilizing ink jet printing technology, a labeling process or a thermal printing process. However, in any printing process, it is desirable that the pressure against the medium be uniformly applied during the printing process in order to insure the highest quality of printing onto the medium.

One of the most popular types of media is optical disks, such as compact disks and digital video disks, or digital versatile disks. The optical disk or CD has recently become a popular form of media for storing digital information, recording high quality audio and video information and also for recording computer software of various types. With advances in technology, it is now possible not only to read information from such optical media, but also to record digital information directly onto the media. For example, recordable compact disks (referred to as CD-Rs) may have digital information recorded on them by placing the CD-R into a compact disk recorder that receives the digital information from a computer. Such forms of optical media are thus particularly useful for data distribution and/or archiving.

Compact disks are standardized in two sizes and configurations, one having an overall diameter of 4.72 inches, a central hole of 0.59 inches, and a central region about the center hole of 1.50 inches in diameter, wherein no information is either printed or recorded, The other standard disk size is 3.5 inches in overall diameter, with a comparable central hole size and central region. In the case of disks for utilization in connection with computer processors, the recording formats and content are typically adapted to the particular generalized type of computer processor with which the disk is to operate. Some compact disks are recorded in such a way as to be usable with several different computer processor types, i.e., PC, Macintosh, etc.

The significant increases in use of CD disks and CD-R disks as a data distribution vehicle has increased the need to provide customized CD label content to reflect the data content of the disk. Initially, the customized label information was "hand written" on the disk surface using felt tipped markers. While this approach permitted users to individually identify disks, it tends to be labor intensive, prone to human error in transcription, and aesthetically limited.

Other attempts to provide a CD or CD-R labeling solution have incorporated digitally printed adhesive labels. Precut labels are printed using desktop or commercial ink-jet, thermal wax transfer, or printers. An example of such labels is the STOMP Company's (Irvine, Calif.) CD Stomper package of die-cut CD labels that can be printed on any 8.5 by 11 inch ink jet or laser electrophotographic printer. Following printing, the labels can be applied manually with or without the aid of an alignment tool or a specially designed machine. This method can be labor intensive, and the CD-R can be damaged if the label is removed. In addition, system performance problems can occur due to disk imbalance or label de-lamination in the CD writer or reader.

Within the past several years, however, methods for direct CD labeling have been growing in prominence. These methods utilize the versatility and ease of the setup associated with digital printing to provide customized label content directly on a disk surface. The most commonly used direct CD printers incorporate ink jet or thermal wax transfer technologies. These printers can be either stand alone or integrated into a computerized disk writing system reducing problems associated with labor, human error, disk damage, and imbalance.

CDs are often coated with a printable surface opposite to the surface from which the information is recorded and retrieved. On the printable surface, a label is printed which can be logos, trademarks, text, graphics, and bar codes, etc., which are related to the information stored on the CD. The label also protects the CD from physical damage. Because the CD spins at high speed in the writer and the player, the CD label needs to be precisely balanced to the center of the disk for smooth rotation.

Labeling of CD disks has routinely been accomplished through screen printing methods. While this method can provide a wide variety of label content, it tends to be cost ineffective for run lengths less than 300–400 disks because the fixed cost on unique materials and set-up are shared by all the disks in each run. The screen printing technique is well described in the textbook "Graphic Arts Manual", edited by Janet and Irving Field, Arno/Musarts Press, New York, N.Y., 1980, pp. 416 to 418. In screen printing a stencil of the image is prepared, placed in contact with the CD and then ink is spread by squeegee across the stencil surface. Where there are openings in the stencil the ink passes through to the surface of the CD, thus producing the image. Preparation of the stencil is an elaborate, time consuming and expensive process.

Accordingly, what is desired is an in-line marking system having a marking device which can mark indicia on a large number of mediums including compact disks in an efficient and expedient manner.

SUMMARY OF THE INVENTION

In accordance with one aspect of the present invention, an in-line marking system includes a dispenser for dispensing a markable medium; a conveyor belt assembly for receiving the medium and conveying the medium from a first position to a second position, the conveyor belt assembly having a plurality of belts forming a conveyor surface; and a marking device located between the first position and the second position for marking indicia on the medium.

In accordance with another aspect of the present invention, an in-line marking system includes a conveyor belt assembly for receiving a markable medium and conveying the medium from a first position to a second position, the conveyor belt assembly having a plurality of belts forming a conveyor surface; a marking device located between the first position and the second position for marking indicia on the medium received on the conveyor belt; and a receptacle for accepting the marked medium.

In accordance with a further aspect of the present invention, a disk transfer system includes a disk dispenser for dispensing disks; a conveyor belt assembly for receiving a disk and passing the disk from a first position to a second position, the conveyor belt assembly having a plurality of belts forming a conveyor surface; and a marking device located between the first position and the second position for marking indicia on the disk.

In accordance with another aspect of the present invention, an in-line marking system includes a dispenser for dispensing a markable medium; a housing having at least one hopper for stacking a plurality of mediums, wherein the dispenser is attached to the hopper for dispensing one medium at a time from the hopper; a conveyor belt assembly for receiving the medium and conveying the medium from a first position to a second position, the conveyor belt assembly having a plurality of belts forming a conveyor surface; a marking device located between the first position and the second position for marking indicia on the medium; a pad located between a first conveyor surface and a second conveyor surface, and a plurality of rollers for guiding the conveyor belt assembly around the pad; and at least one sensor for directing the marking of the medium.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

This invention provides a system and method for marking indicia on a markable medium including optical media, such as compact disks, CD-Rs, CD-RWs, digital video disks or digital versatile disks, computer chips, paper products, and paper like products. The system and method provide for the marking of a large number of media in an efficient and expedient manner. The in-line marking system may be used as part of or in conjunction with systems for handling, printing, duplicating or replicating of markable mediums.

Figure 1:
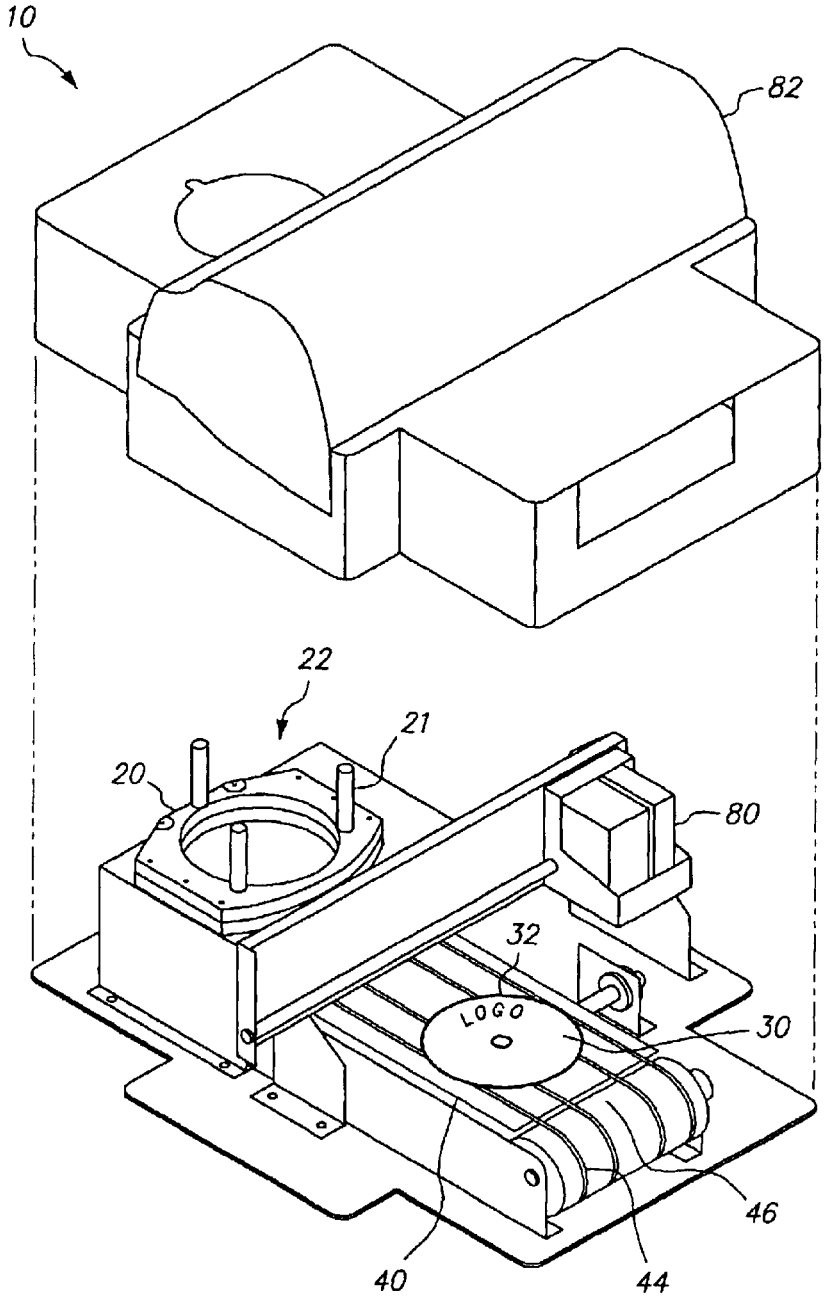
FIG. 1 is a perspective view of an in-line marking system in accordance with the present invention.

FIG. 1 shows an in-line marking system, generally designated with the reference numeral 10. The system 10 includes a dispenser 20, a conveyor belt assembly 40, a marking device 80 and a cover 82.

The dispenser 20 dispenses a markable medium 30 from a housing 22 onto the conveyor belt assembly 40. The conveyor belt assembly 40 receives the medium 30 from the dispenser 20 and conveys the medium 30 from a first position to a second position. The conveyor belt assembly 40 has a plurality of belts 44 forming a conveyor surface 46. A marking device 80 located between the first position and the second position marks the medium 30 with indicia 32. The indicia 32 can include names, logos, trademarks, text, graphics, bar codes, designs or any other descriptive or unique marking to identify or associate the medium with a manufacturer or for identification of the content of the medium, marketing, sales and cataloging of information.

The marking device 80 will preferably be a silk screen printer, a printer utilizing ink jet printing technology, a labeling process, or a thermal printing process. However, it can be appreciated that the marking device 80 can be a duplicating or a replicating device.

The cover 82 prevents the dispenser 20, the conveyor belt assembly 40 and the marking device 80 from being damaged during transportation or use and further prevents dust and other particles from collecting on the dispenser 20, conveyor belt assembly 40, or marking device 80.

Figure 2:
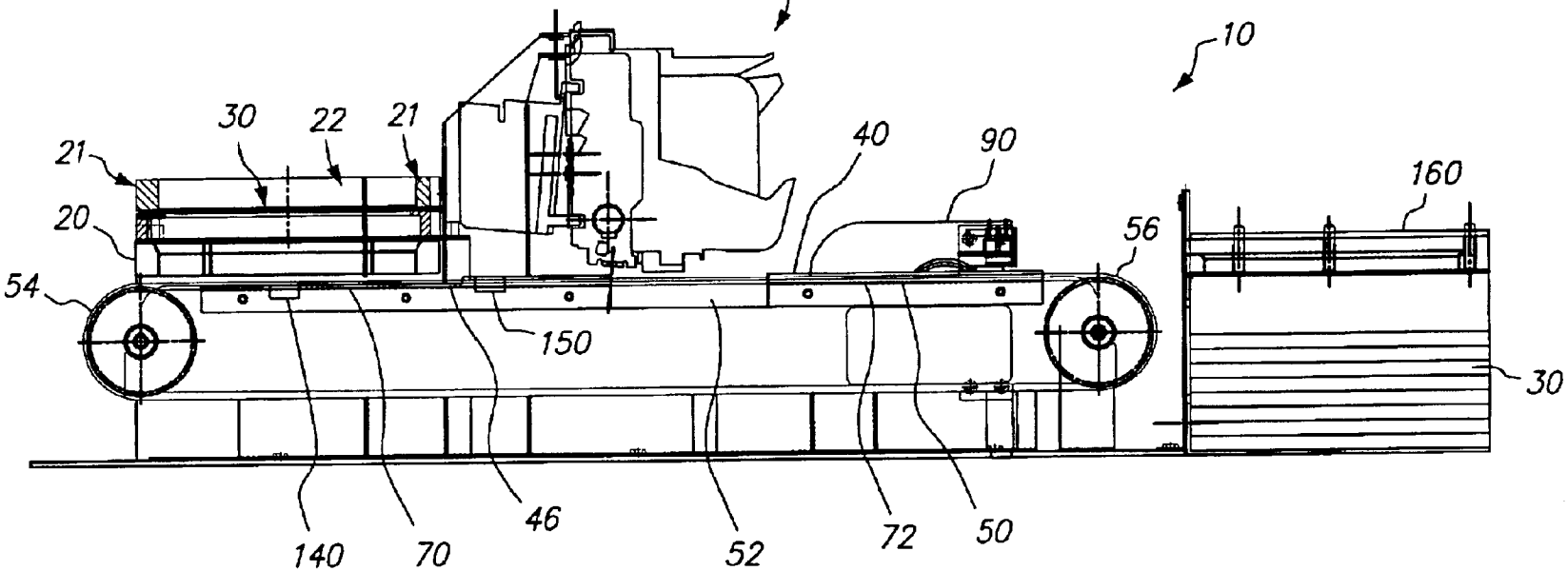
FIG. 2 is a side elevation view of the in-line marking system of FIG. 1.

FIG. 2 shows a side elevation view of the in-line marking system 10 of FIG. 1. As shown in FIG. 2, the in-line marking system includes the dispenser 20 for dispensing the markable medium 30 onto the conveyor belt assembly 40. The belts 44 of the conveyor belt assembly 40 are looped around a first roller 54 and a second roller 56.

The dispenser 20 dispenses the markable medium 30 onto the conveyor belt assembly 40 from the housing 22. The housing 22 attaches to the dispenser 20 and includes a plurality of posts 21 for holding a plurality of mediums 30. The dispenser 20 is located over the conveyor belt assembly 40 such that the medium 30 is individually dispensed onto the conveyor belt assembly 40. The dispenser 20 dispenses the medium 30 at a predetermined interval or alternatively, the medium 30 can be dispensed at variable intervals. The dispensing of the medium 30 onto the conveyor belt surface 46 is controlled by a microprocessor 120 and a first sensor 140. The first sensor 140 is preferably located beneath the disk dispenser 20. However, it can be appreciated that the first sensor 140 can be located anywhere on the system 10 as long as the sensors can control the dispensing of the medium 30 onto the conveyor surface 46.

Although only a single housing 22 is shown in FIG. 2, the present invention is intended to mark a multitude of mediums 30, such that, multiple housings or a conveyor fed system to the dispenser can be used. For example, the housing 22 can hold mediums 30 in groups of 25, 50, 100 or even 150 at a time.

In one embodiment, the dispenser 20 is a dispenser as described in Wolfer et al., U.S. Pat. No. 6,135,316, which is incorporated herein by reference in its entirety. The dispenser 20, as disclosed in U.S. Pat. No. 6,135,316, dispenses a medium 30 from the bottom of a stack of mediums 30 having an upper guide, a lower guide and a plate slidably mounted between the upper guide and the lower guide. The upper guide and lower guide define an opening, wherein the plate slides to dispense the medium 30 through the lower guide opening. However, it can be appreciated that the dispenser 20 can use pick and place technology or any other known method for dispensing a disk or medium 30 onto a conveyor belt assembly 40.

In a preferred embodiment, the markable medium 30 includes optical disks or magnetic memory storage media including compact disks, CD-Rs, CD-RWs, digital video disks or digital versatile disks, and the like. However, a variety of media including optical or magnetic memory storage media can be dispensed and marked or duplicated in accordance with the present invention. In addition, as will be recognized by one skilled in the art and as set forth above, the markable medium 30 can be of any desired shape and size.

Generally, the marking device 80 for printing information and graphics on the surface of a medium 30, particularly compact disks, will include one or more of the following devices or printing processes: a silk screening printer, a printer utilizing ink jet printing technology, a labeling process or a thermal printing process. The marking device 80 is preferably interchangeable, such that more than one type of marking device 80 can be used with each in-line marking system 10. For example, the marking device 80 is preferably interchangeable such that it will accommodate a print engine, or a duplicator. Alternatively, the system can be designed for a single marking device 80. However, in any marking device 80, it is desirable that the pressure against the medium be uniformly applied during the marking (or printing) process in order to insure the highest quality of marking onto the medium 30.

In addition, it can be appreciated that any commercial available print engine, such as those manufactured by Lexmark, Hewlett-Packard or Compaq can be used as a marking device 80. The indicia 32 information will preferably be delivered to the marking device 80, via a computer or microprocessor, such as a commercially available Pentium-type processor or any other known processor. According to one variation of the invention, the marking device 80 is a CD printer for printing indicia on disk surfaces and the dispenser 20 dispenses disks to the CD printer.

The marking device 80 is located between a first position 70 and a second position 72 of the in-line marking system 10. The marking device 80 is located above the conveyor belt assembly 40 and marks indicia 32 on the medium 30. In addition; it can be appreciated that the marking device 80 can include a duplicating and/or a replicating device for producing multiple copies of the medium. For example, with optical disks, as will be recognized by one skilled in the art, the marking device could include a disk writer or any other known optical disk duplicator.

The first roller 54 is located nearest the dispenser 20 and is preferably a free wheel. However, it can be appreciated that the first roller can also be a fly wheel or balance wheel. The first roller 54 rotates with the movement of the conveyor belt 44.

The second roller 56 is located nearest the marking device 80 and is driven by a conventional drive gear and DC motor assembly 90 to incrementally advance the second roller 56 in response to the rotation of the motor. The second roller 56 is also preferably a fly wheel, however, it can be appreciated that the second roller 56 can be a balance wheel, or any other type of wheel capable of being driven by the motor assembly 90. The rollers 54, 56 are preferably made of aluminum or molded plastic. However, almost any material, including steel, wood, or rubber can be used, as long as the rollers 54, 56 has appropriate friction to rotate the conveyor belt assembly 40 and conveyor belts 44.

As shown in FIG. 2, the in-line marking system 10 has a receptacle 160 for receiving the medium 30 after marking of the medium 30 with indicia 32. The receptacle 160 can be a basket, a hopper with a spring loaded basket, or any other suitable device for receiving the medium 30 from the conveyor belt assembly 40. Alternatively, the receptacle 160 can be an upstacker (as shown in FIGS. 9 and 11–13) as disclosed in Wolfer et al., U.S. Pat. No. 6,337,842, and U.S. patent application Ser. No. 09/828,569, filed on Apr. 5, 2001, which are incorporated herein by reference in their entirety.

Figure 3:
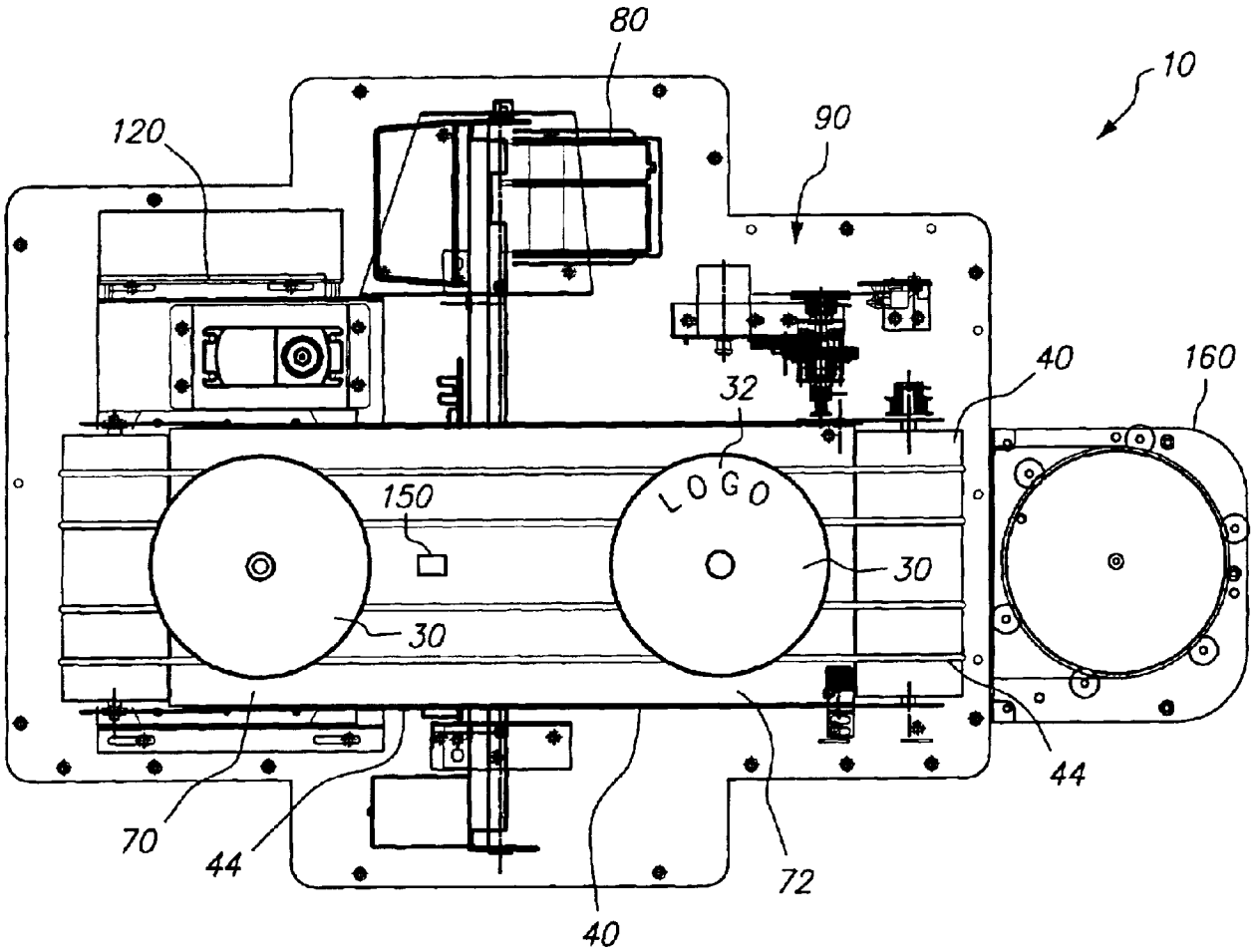
FIG. 3 is a top view of the in-line marking system of FIG. 1.

FIG. 3 shows a top view of the in-line marking system 10 of FIG. 1. In addition to the disk dispenser 20, the conveyor belt assembly 40, the marking device 80, the first sensor 140, and the receptacle 160 for accepting the mediums after marking, the in-line marking system 10 includes a microprocessor 120 that receives instructions from a host device, typically a computer, such as a personal computer (not shown), or can be programmed internally. It can be appreciated that the microprocessor 120 can be a microcomputer or loader board.

The motor assembly 90 drives the conveyor belt assembly 40 via the second roller 56 (as shown in FIG. 2) by rotating a gear drive in short and essentially uniform angular movements. The motor assembly 90 operates according to a predetermined acceleration and velocity profile that is controlled by an algorithm programmed in the microprocessor 120, or alternatively in response to control signals received from the microprocessor 120. The predeterrnined acceleration and velocity profile ensures that the speed of the conveyor belt assembly 40 and the marking device 80 are equal, which allows the marking device 80 to mark the medium 30 in one continuous movement. The marking device 80 marks the medium 30 as the medium 30 moves from the first position 70 through the marking device 80 to the second position 77. Thus, this avoids the necessity of having to stop and start the conveyor belt assembly 40 for each and every medium 30.

In a preferred embodiment, the motor assembly 90 includes a gear reduced, DC motor. However, it can be appreciated that the motor assembly 90 can include a magnetic stepper motor, servo motor, a stepper motor, step-servo motor, or any other means which controls the conveyor belt assembly 40 in short and essentially uniform angular movements.

The microprocessor 120 directs the dispensing and the marking process of the system 10. The microprocessor 120 controls the dispenser 20, the marking device 80, and the motor assembly 90 and thereby the conveyor belt assembly 40 by receiving a plurality of signals from sensors located throughout the system 10. It can be appreciated that the number of sensors needed varies based on the embodiment, including the type of the disk dispenser 20, and the marking device 80. For example, if the marking device is a duplicating and replicating device for producing multiple copies of the medium 30, the system 10 may require a plurality of sensors rather than one or two sensors.

In operation, the first sensor 140 senses the presence of the medium 30 on the conveyor belt assembly 40 and communicates the presence of the medium 30 to the microprocessor 120. The microprocessor 120 then directs the motor assembly 90 to advance the second roller 56. The second roller 56 rotates causing the conveyor surface 46 to rotate and advances the medium 30 toward the marking device 80. The first sensor 140 is preferably an optical proximity sensor having a light-emitting diode (LED) and a receptor . However, it can be appreciated that the first sensor 140 can be any type of sensor including micro-switches, capacitive sensors, inductive sensors, or magnetic read switches, which recognize the presence of the medium 30 on the conveyor surface 46.

The first sensor 140 is also able to detect the presence or absence of a medium 30 in the dispenser 20. The microprocessor 120 receives a signal from the first sensor 140 and uses this information to determine whether the mediums 30 in the dispenser 20 need to be refilled. If a medium 30 is present in the dispenser 20, a signal is sent from the microprocessor 120 to the dispenser 20 to dispense the medium 30 onto the conveyor surface 46 for marking by the marking device 80.

A second sensor 150 is located on or near the conveyor surface 46 and detects the presence of the medium 30 on the conveyor surface as the medium 30 advances toward the marking device 80. In one embodiment, the second sensor 150 is a flag sensor which has a pivoting lever which detects the medium 30 as the medium 30 advances. However, as with any of the sensors of the system 10, the second sensor 150 can be an optical proximity sensor, a micro-switch, a capacitive sensor, an inductive sensor, a magnetic read switch or any other sensor known to one skilled in the art which recognizes the presence of the medium 30 on the conveyor surface 46.

The second sensor 150 sends a signal to the microprocessor 120 to begin the marking process. Once the marking process has been completed, if appropriate, the microprocessor 120 sends another signal to the dispenser 20 to release another medium 30 onto the conveyor surface 46 or alternatively the microprocessor 120 directs the system 10 to cease operation. In addition, the microprocessor 120 controls the movement of the conveyor belts 44 such that the medium 30 is dispensed onto the conveyor surface 46 at the correct intervals.

The conveyor belt assembly 40 conveys the medium 30 from the first position 70 to the second position 72. The movement of the conveyor belt assembly 40 enables the dispenser 20 to dispense another medium 30 onto the conveyor belt assembly 40 without having to interrupt the marking process. Thus, the continuous movement of the conveyor belt assembly increases production over traditional pick and place technology. In a preferred embodiment, the conveyor surface 46 includes a plurality of belts 44 for conveying the medium 30 from the disk dispenser 20 to the marking device 80. However, any type of conveyor system known to one skilled in the art may be used to convey the medium 30 to the marking device 80.

The chassis assembly 50 preferably has a length of between approximately 12 inches and approximately 72 inches, and a width of between approximately 4 inches to approximately 12 inches. The chassis assembly 50 includes a support frame 52 located between the first roller 54 and the second roller 56. The belts 44 preferably will lay flat or planar on top of the support frame 52 of the chassis assembly 50, which ensures a stable and uniform marking process, as the endless belts 44 loop around the first and second rollers 54, 56. The belts 44 move in a continuous loop from the first position 70 to the second position 72 and then back to the first position 70.

The belts 44 are made of a material which is relatively non-stretchable, such as neoprene, a synthetic rubber which is not only extremely resistant to damage caused by flexing and twist, but has outstanding physical toughness such that it will not deform over time. Neoprene is also extremely soft and provides a non-slip surface such that the medium 30 is not harmed as the medium 30 is conveyed from the dispenser 20 through the marking device 80. However, it can be appreciated that the belts 44 can be made of plastic, nylon, rubber, or any other material which will provide the characteristics necessary to allow the marking device 80 to mark the medium 30 without affecting the quality of the marking process.

The belts 44 preferably have a length of between about 24 inches and about 144 inches. In addition, the belts 44 are preferably approximately ⅛ of an inch in diameter and round. However, a rectangular or flat belt can be used, provided the conveyor surface 46 is flat. It is preferable that the medium 30 rests level on the conveyor surface 46 for optimum marking by the marking device 80. Optimally, at least three or four belts are used to define the conveyor surface 46. However, any number of belts can be used to define the conveyor surface 46. Furthermore, the belts 44 can have a diameter from approximately 1/64 of an inch to approximately 1 inch depending on the size of the system 10 and medium 30 being used. The belts are also spaced apart from approximately ½ of an inch to approximately 2 inches depending on the size of the belts and the medium to be used. For compact disks and other optical media having an overall diameter of 3.5 or 4.72 inches, a belt having a diameter of approximately 1/16 of an inch to approximately ⅜ of an inch is preferred.

Since the medium 30 can include optical disks which are circular in shape, computer chips which are rectangular, or any paper product or like material including plastics, rubbers, Mylar, foils, fabric, metals, or nylons which have a variety of shapes, the conveyor belt assembly 40 and/or marking device 80 is preferably adjustable, such that mediums 30 of different thicknesses can be marked. Adjustment of the conveyor belt assembly 40 or marking device 80 can be made by any method known to one skilled in the art, including raising or lowering the conveyor belt assembly 40 and/or marking device 80.

Figure 4:
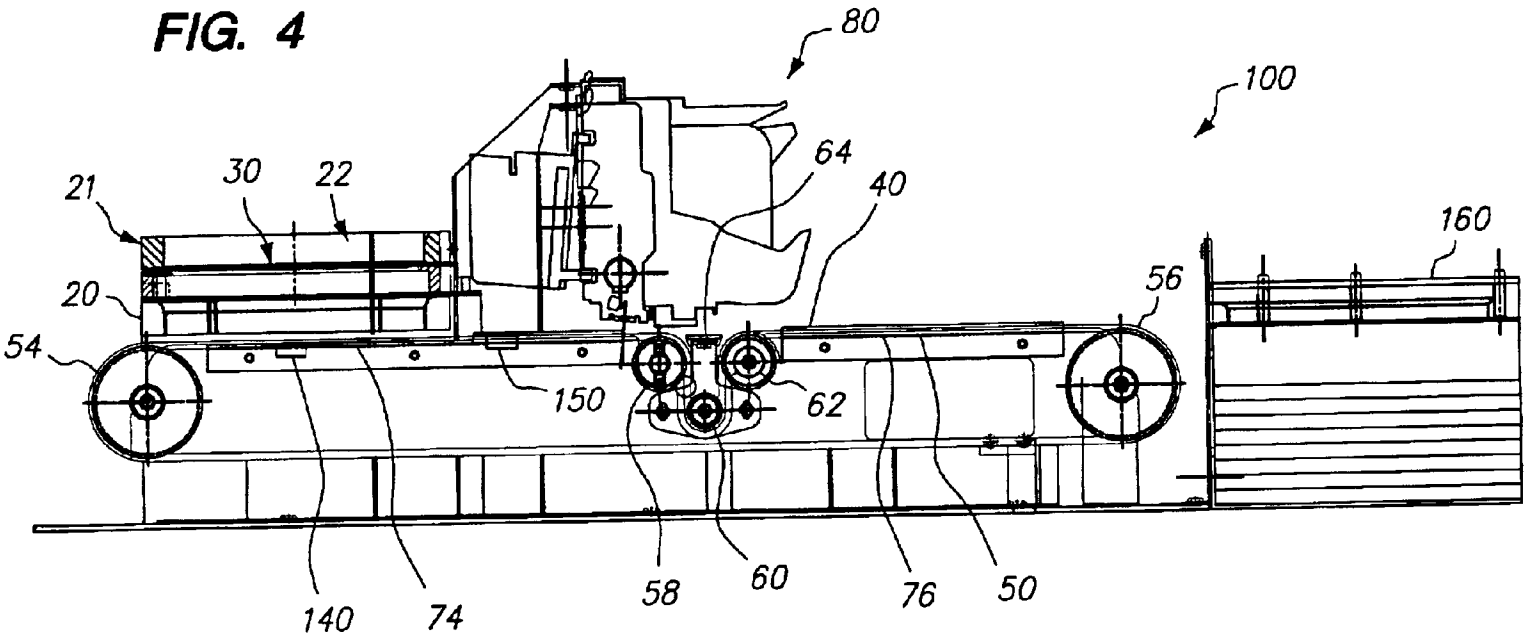
FIG. 4 is a side elevation view of an alternative embodiment of the in-line marking system.

FIG. 4 shows an alternative embodiment of an in-line marking system, generally designated with the reference numeral 100. The system 100 has all of the elements of system 10 of FIG. 1. The system 100 further includes a third roller 58, a fourth roller 60, a fifth roller 62, and a pad 64. The third, fourth, and fifth rollers 58, 60, and 62 guide the conveyor belts 44 around the pad 64 which catches overspray from the marking device 80. In addition, the motor assembly 90, including the drive gear and motor, are coupled to the third roller 58. Accordingly, the movement of the conveyor belt assembly 40 and conveyor belts 44 is controlled by the third roller 58 located beneath the marking device 80, rather than the second roller 56 of system 10.

As the conveyor belts 44 proceed from the first position 70 to the second position 72, at the marking device 80, the third roller 58, fourth roller 60 and fifth roller 62 guide the conveyor belts 44 around the pad 64. The third roller 58 attaches to the motor assembly 90 and controls the movement of the conveyor belt assembly 50 in short and essentially uniform angular movements. The fourth and fifth rollers 60 and 62 are preferably fly wheels. However, it can be appreciated that the fourth and fifth rollers 60 and 62 can be a balance wheel or any type of wheel or device which guide the belts 44 from the support frame 52 around the pad 64.

The pad 64 is located underneath the marking device 80. The pad 64 or diaper is made of a material such as felt, sponge-like material, or any other material which will absorb over spray from the marking device 80. The pad 64 will extend the width of the conveyor belt assembly 40 having a length of approximately 10% to approximately 75% of its width. In a preferred embodiment, the pad is replaceable. It can be appreciated, however, that the system 10 can be designed with or without the pad 64 depending on the type of marking device that is used.

Figure 5:
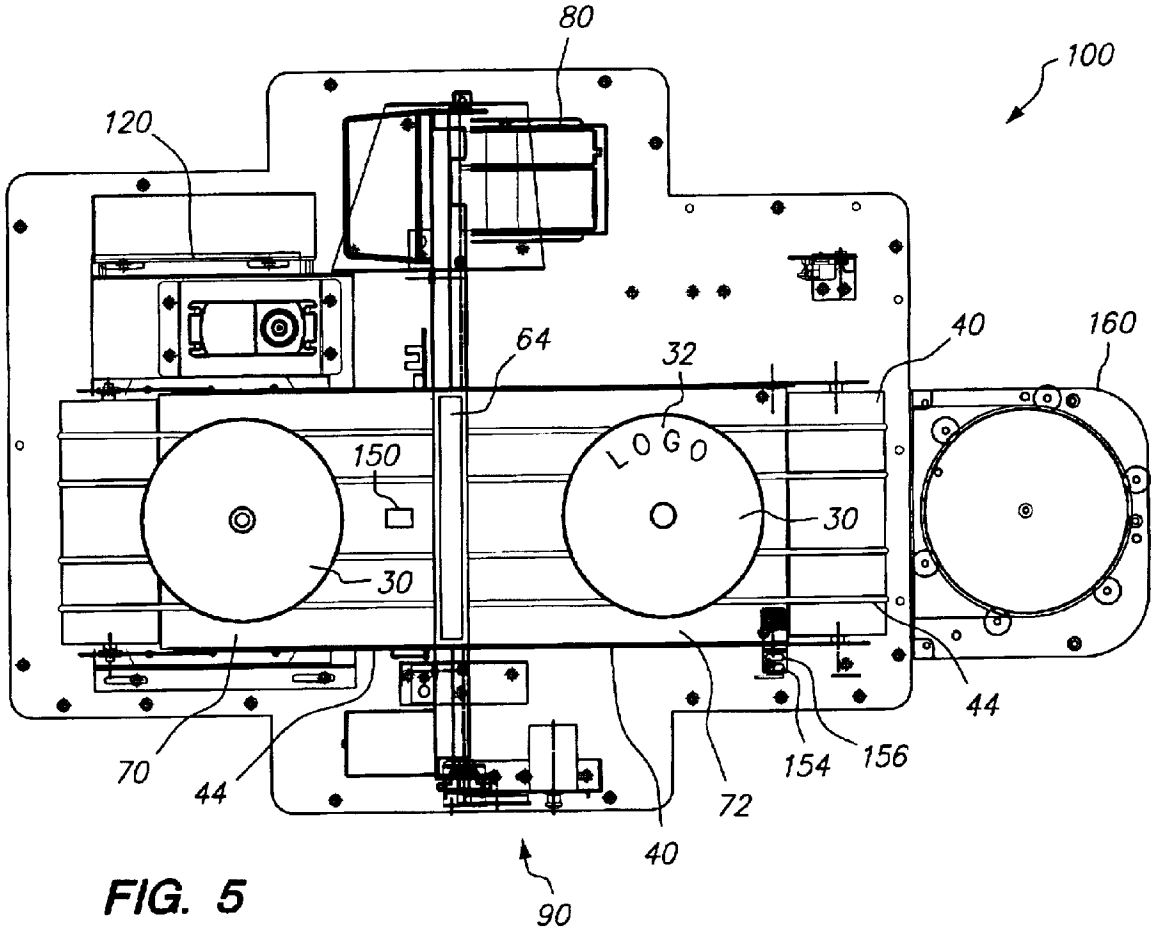
FIG. 5 is a top view of the in-line marking system of FIG. 4.

FIG. 5 shows a top view of the system 100, including the pad 64 and the motor assembly 90. In this system 100, the motor assembly 90 is preferably located adjacent to the third roller 58, rather than adjacent to the second roller 56.

Figure 6:
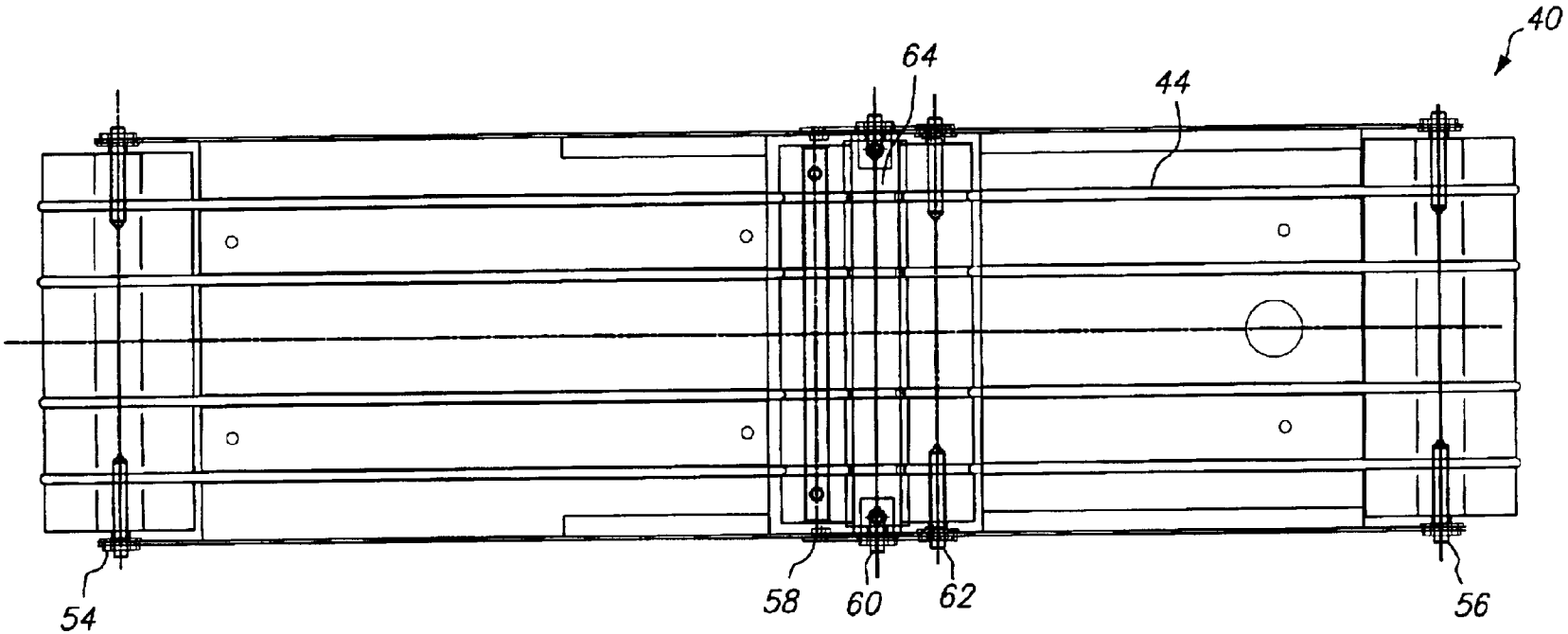
FIG. 6 is a top view of the conveyor belt assembly of the in-line marking system.

FIG. 6 show a top view of the chassis assembly 50. The chassis assembly 50 includes the plurality of belts 44, the first roller 54, the second roller 56, the third roller 58, the fourth roller 60, the fifth roller 62 and the pad 64.

Figure 7A:
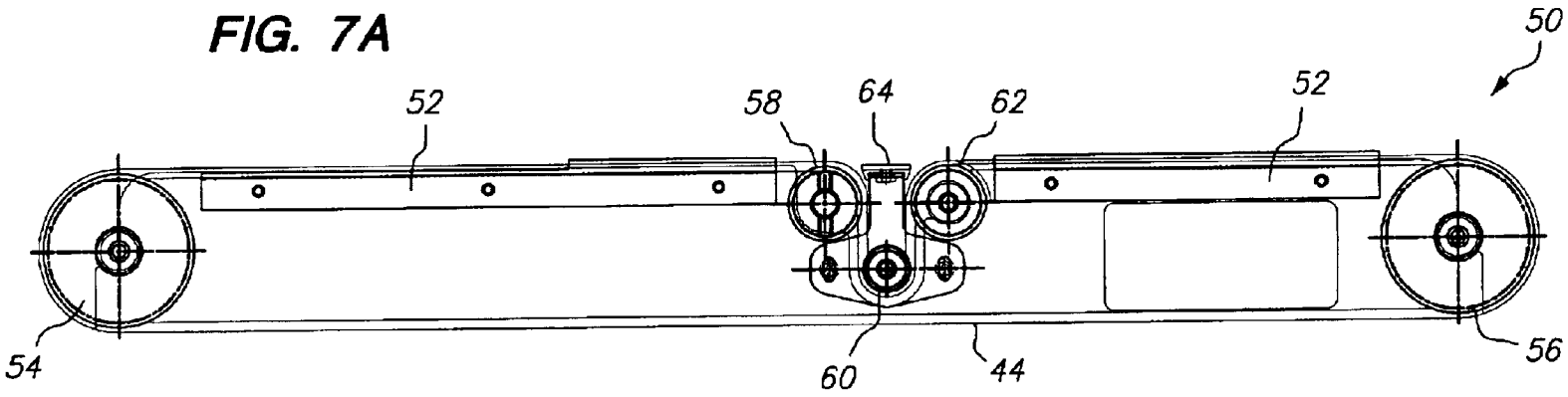
FIGS. 7A and 7B are side elevation views of a conveyor belt assembly of the in-line marking system according to two variations of this invention.

FIG. 7A shows a side elevation view of the chassis assembly 50 including the support frame 52, the first roller 54, the second roller 56, the third roller 58, the fourth roller 60, the fifth roller 62, and the pad 64. The belts 44 preferably will lay flat or planar on top of the support frame 52 of the chassis assembly 50, which ensures a stable and uniform marking process, as the endless belts 44 loop around the first roller 54 and the second roller 56. The support frame 52 is preferably made of two separate sections 74, 76 with the third roller 58, fourth roller 60, fifth roller 62, and the pad 64 located between the two separate sections 74, 76 and the support frame 52. Alternatively, as shown in system 10 (FIG. 2), a single support frame 52 can be used without the third roller 58, the fourth roller 60, the fifth roller 62 and the pad 64.

Figure 7B:
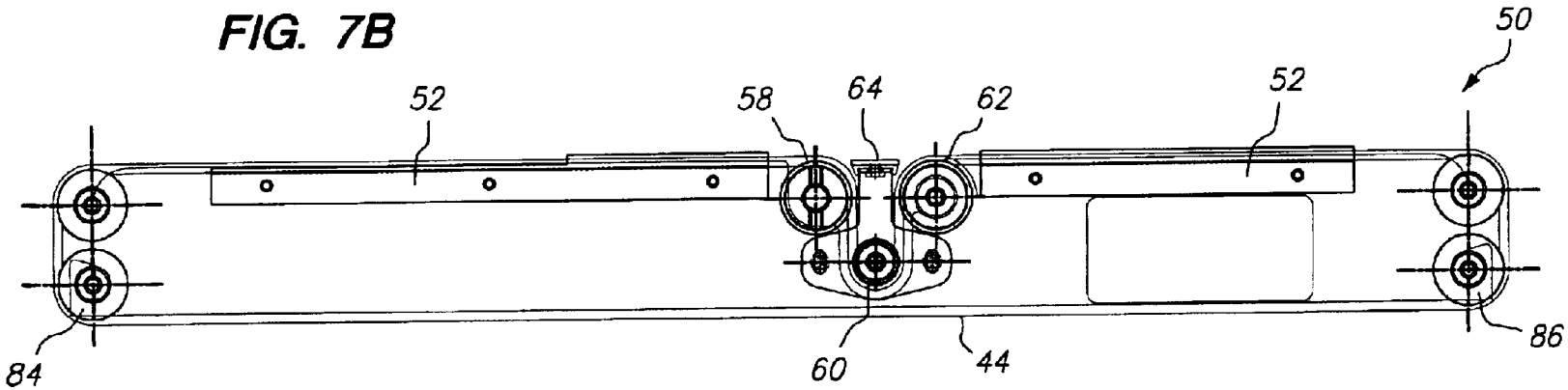

In an alternative embodiment of the chassis assembly 50 as shown in FIG. 7B, the chassis assembly includes the support frame 52, a pair of first rollers 84 and a pair of second rollers 86. Each of the rollers in the pair of first rollers 84 and the pair of second rollers 86 preferably have a uniform diameter for directing the plurality of belts 44 in a continuous loop.

Figure 8A:
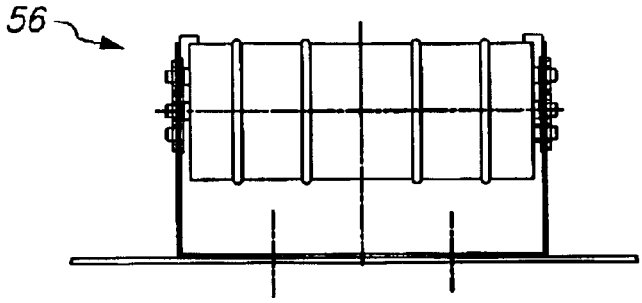
FIGS. 8A and 8B are end elevation views of a conveyor belt assembly of the in-line marking system according to two variations of this invention.
Figure 8B:
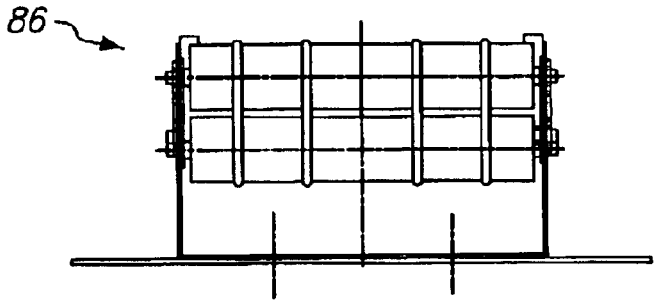

FIG. 8A and 8B show the alternative embodiments of FIGS. 7A and 7B having a single second roller 56 or pair of second rollers 86, respectively. Each embodiment can be utilized with either system 10 or system 100. It can be appreciated that the size of the rollers and number of rollers can vary depending on the type of marking system.

FIGS. 9–13 show an alternative embodiment of the systems of FIGS. 1–8, generally designated with reference numeral 200. In this embodiment, the system 200 includes a dispenser 210, a housing 230, a conveyor belt assembly 250, a marking device 280, a pad 290, a sensor 310 and a receptacle 330.

Figure 9:
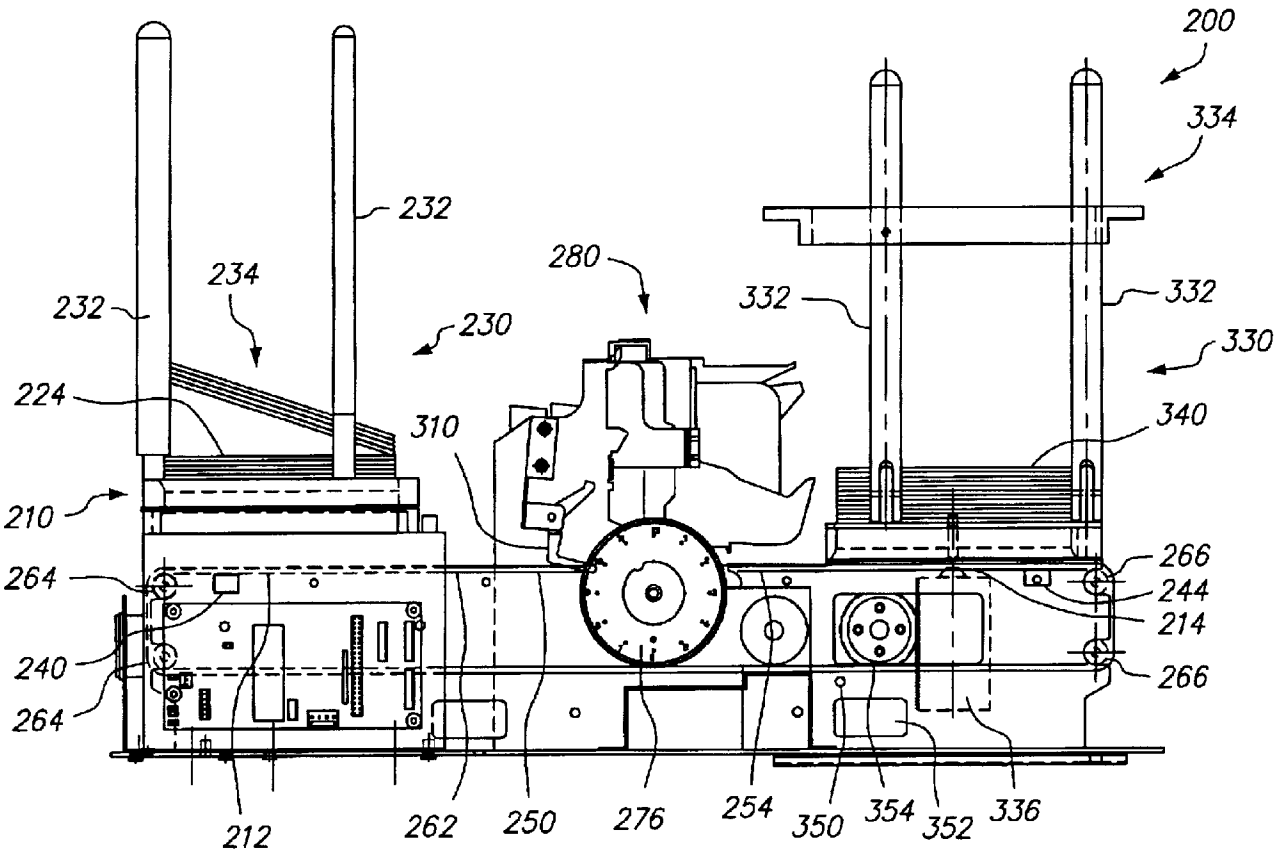
FIG. 9 is a side elevation view of an alternative embodiment of the in-line marking system.
Figure 10:
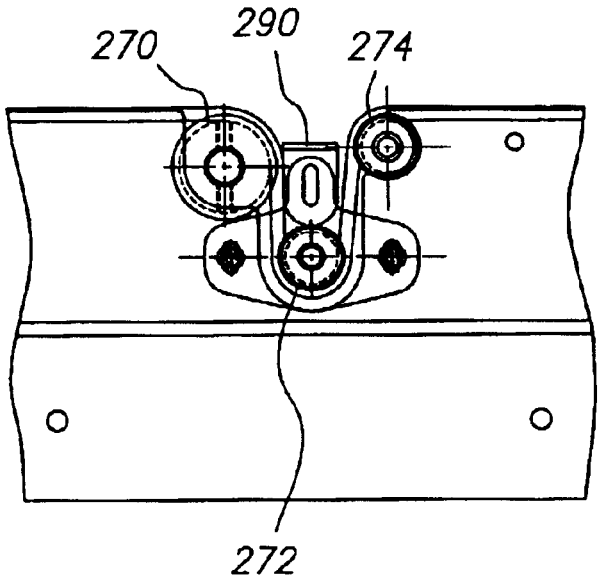
FIG. 10 is a cross-sectional view of the alternative embodiment of the in-line marking system of FIG. 9 along the line 10—10.
Figure 11:
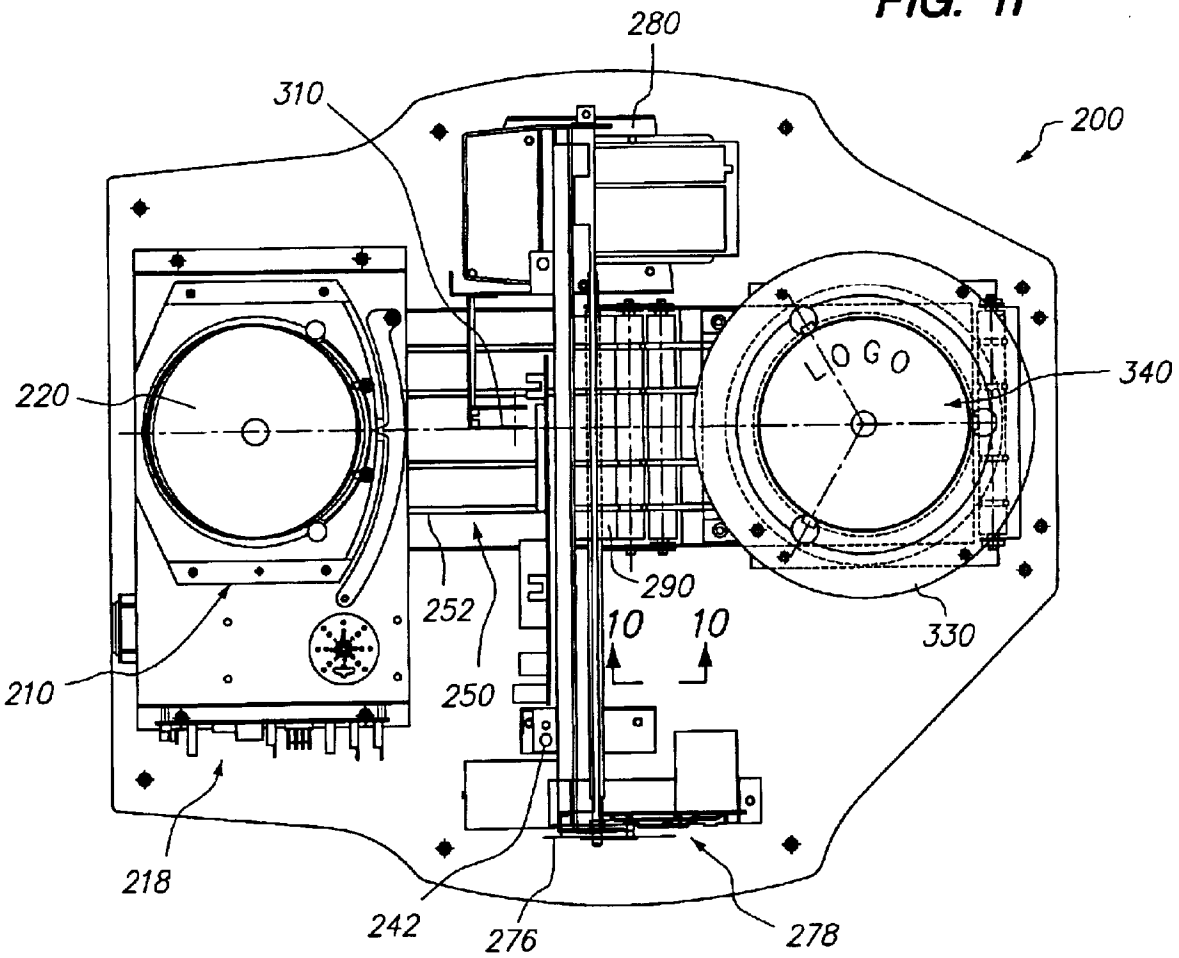
FIG. 11 is a top view of the in-line marking system of FIG. 9.
Figure 12:
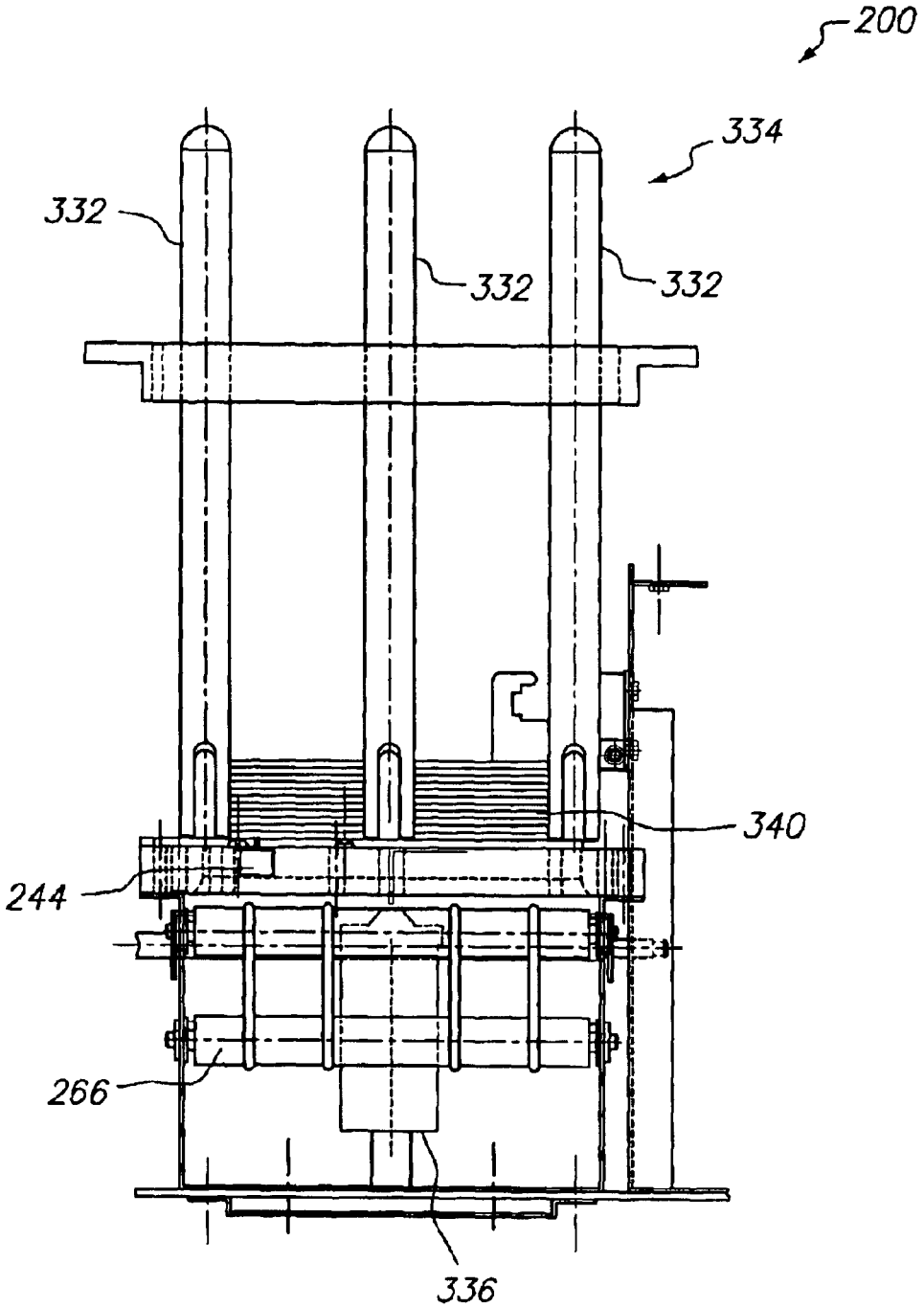
FIG. 12 is an end elevation view of the in-line marking system of FIG. 9.
Figure 13A:
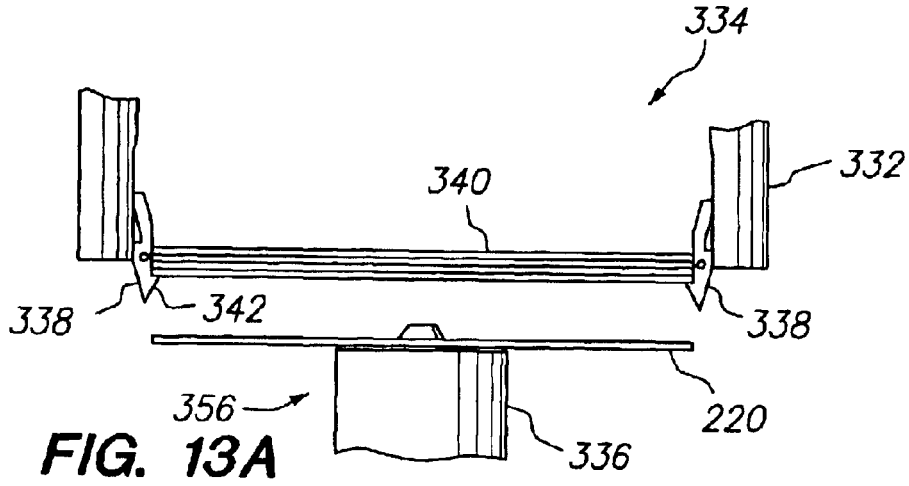
FIGS. 13A–D are elevation views of a receptacle of the in-line marking system of FIG. 9 in operation.
Figure 13B:
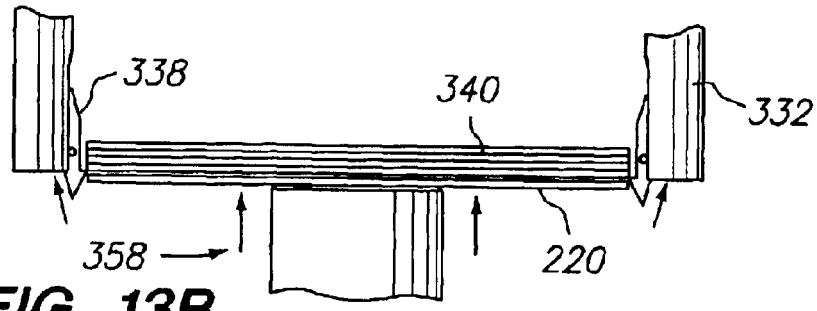
Figure 13C:
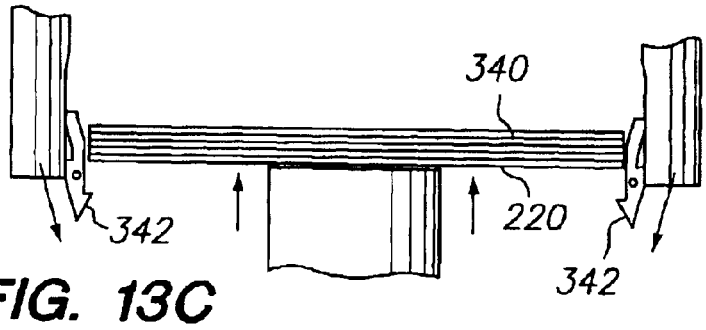
Figure 13D:
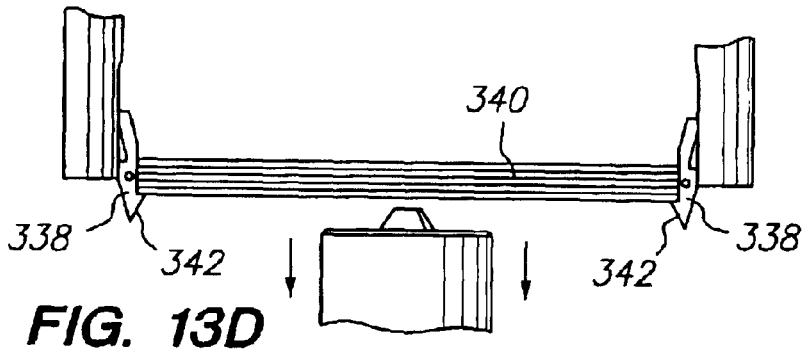

As shown in FIG. 9, the dispenser 210 dispenses a markable medium 220 from the housing 230 onto the conveyor belt assembly 250. The conveyor assembly 250 has a plurality of belts 252 forming a conveyor surface 254. The conveyor belt assembly 250 conveys the medium 220 on the conveyor surface 254 from a first position 212 to a second position 214. A marking device 280 located between the first position 212 and the second position 214 marks the medium 220 with indicia 222.

The dispenser 210 receives the markable medium 220 from the housing 230. The housing 230 includes a plurality of posts 232 forming a hopper 234 for holding a stack 224 of mediums 220. The housing 230 including the stack 224 of mediums 220 is mounted to the dispenser 210. The dispenser 210 is located over the conveyor belt assembly 250 such that a medium 220 can be individually dispensed onto the conveyor belt assembly 250.

In one embodiment of this system 200, the dispensing of the medium 220 onto the conveyor belt assembly 250 is controlled by a first sensor 240 located beneath the dispenser 210. The first sensor 240 interfaces with a microprocessor 218 by sending a plurality of signals to the microprocessor 218 to communicate the presence or absence of a medium 220 in the dispenser 210.

In operation, the microprocessor 218 receives a plurality of signals from the first sensor 240 indicating the presence or absence of a medium 220 in the dispenser 210. If a medium 220 is present in the dispenser 210, a signal is sent to the microprocessor 218 indicating the presence of a medium 220 in the dispenser 210. A second signal is then sent to the dispenser 210 to dispense the medium 220 onto the conveyor belt surface 254. If the first sensor 240 does not detect the presence of a medium 220 in the dispenser 220, a signal is sent to the microprocessor 218 indicating that the hopper 234 needs to be refilled. It can be appreciated that the first sensor 240 can be located anywhere on the system 200 as long as the first sensor 240 can control the dispensing of the medium 220 onto the conveyor belt assembly 250.

The first sensor 240 is preferably a proximity sensor having a light-emitting diode (LED) and a receptor. However, the first sensor 240 can be any type of sensor including micro-switches, capacitive sensors, inductive sensors, or magnetic read switches, which recognize the presence of the medium 220 on the conveyor surface 250.

In one embodiment of this system 200, the dispenser 210 is preferably a dispenser 210 as described in Wolfer et al., U.S. Pat. No. 6,135,316, which is incorporated herein by reference in its entirety. The dispenser 210, as disclosed in U.S. Pat. No. 6,135,316, dispenses a medium 220 from the bottom of a stack 224 of mediums 220. The dispenser 210 has an upper guide, a lower guide and a plate slidably mounted between the upper guide and the lower guide. The upper guide and lower guide define an opening, wherein the plate slides to dispense the medium 220 through the lower guide opening onto the conveyor belt assembly 250. It can be appreciated, however, that the dispenser 210 can use pick and place technology or any other known method for dispensing a disk or medium 220 onto a conveyor belt assembly 250.

The conveyor belt assembly 250 conveys the medium 220 from the first position 212 to the second position 214. The movement of the conveyor belt assembly 250 enables the dispenser 210 to continuously dispense mediums 220 onto the conveyor belt assembly 250 without having to interrupt the marking process.

The conveyor belt assembly 250 includes a support frame 262, a pair of first rollers 264, a pair of second rollers 266, a third roller 270, a fourth roller 272, a fifth roller 274 and a pad 290. The support frame 262 is located between the pair of first rollers 264 and the pair of second rollers 266. The belts 252 preferably will lay flat or planar on top of the support frame 262 of the conveyor belt assembly 250. The support frame 262 ensures a stable and uniform marking process. The endless belts 252 loop around the pair of first rollers 264 and the pair of second rollers 266 forming the conveyor surface 254. The pair of first rollers 264 and the pair of second rollers 266 are preferably fly wheels having a uniform diameter for each of the rollers.

As shown in FIG. 9, the third roller 270, fourth roller 272 and fifth roller 274 are located beneath the marking device 280 and guide the conveyor belts 244 around the pad 290. The pad 290 catches over spray and excess ink from the marking device 280 during the marking of the medium 220. Accordingly, the pad 290 can be constructed of a felt like material or any other type of absorbable material for catching the over spray. The pad 290 is replaceable and can be designed based on the type of marking device 280. It can be appreciated, however, that the system 200 can be designed with or without the pad 290 depending on the type of marking device 280 that is used.

The first roller 270 attaches a motor assembly 278, including a gear drive and motor. A set of gears 276 imparts a rotation motion to the first roller 270. In the preferred embodiment of this system 200, the motor assembly 278 includes a DC motor. However, it can be appreciated that the motor assembly 278 can also include a magnetic stepper motor, servo motor, a stepper motor, a step-servo motor, or any other means which controls the conveyor belt assembly 250 in short and essentially uniform angular movements.

The first roller 270 controls the movement and rotation of the conveyor belt assembly 250 by imparting a uniform rotational velocity to the conveyor belt assembly 250. Furthermore, by controlling the movement of the conveyor belt assembly 250, the first roller 270 controls the speed of the marking process which will ensure a consistent and uniform marking process. It can be appreciated that the speed of the conveyor belt assembly can vary depending on the type of marking device.

The second roller 272 and third roller 274 guide the conveyor belt assembly around the pad 290. The first roller 272 preferably has a diameter greater than the diameter of the second roller 272 and the third roller 274, since the first roller 270 controls the movement of the conveyor belt surface 254. Generally, the second roller 272, the third roller 274, the first pair of rollers 264 and the second pair of rollers 266 will have a smaller diameter since they guide the conveyor belt surface 254. For example, the first roller 270 can have a diameter of approximately ⅞ of an inch. Meanwhile, the second roller 272, the third roller 274, the first pair of rollers 264 and the second pair of rollers 266 can have a diameter of approximately ⅝ of an inch. However, it can be appreciated that the diameter of the first roller 270, the second roller 272, the third roller 274, the first pair of rollers 264 and the second pair of rollers 266 can vary depending on the size of the device and the medium in which the device is designed.

The marking device 280 will preferably be a silk screen printer, a printer utilizing ink jet printing technology, a labeling process or a thermal printing process. However, it can be appreciated that the marking device can be a duplicating, a replicating device, or a reading and recording device. In addition, the system 200 can be a stand-alone printer.

The second sensor 310 directs the marking of the medium 220. In one embodiment, the second sensor 310 is a flag sensor located on a pivot just above the conveyor belt surface 254 between the dispenser 210 and the marking device 280. As the medium 220 advances toward the marking device 280, the medium 220 will trip the second sensor 310 which starts the marking process. The second sensor 310 communicates with the microprocessor 218 by sending a plurality of signals to indicate the presence of a medium 220 on the conveyor belt surface 254, and the position of the medium 220 on the conveyor belt surface 254 including the relative positions of the medium to the marking device 280. The second sensor 310 also communicates with the microprocessor 218 to supply power to the marking device 280. The second sensor 310 can alternatively be an optical proximity sensor, a micro-switch, a capacitive sensor, an induction sensor, a magnetic read switch or any other sensor known to one skilled in the art which recognizes the presence of the medium 220 on the conveyor belt surface 254 and is able to control the marking process.

In addition, the marking device 280 includes a first micro-switch 242 to assist with the dispensing of the medium 220 onto the conveyor belt surface 254. The first micro-switch 242 is located on the marking device 280 and interfaces with the microprocessor 218 by sending a plurality of signals to the microprocessor 218. The first micro-switch 242 communicates the status of the marking process including communicating with the dispenser 210 via the microprocessor 218 to dispense a medium 220 onto the conveyor belt surface 254.

Once the marking process has been completed, the conveyor belt assembly will advance the medium 220 to the second position 214 wherein the medium 220 is placed in a receptacle 330 for holding a stack of mediums 220.

In one embodiment, the receptacle 330 is an upstacker as disclosed in Wolfer et al. U.S. Pat. No. 6,337,842 and U. S. patent application Ser. No. 09/828,569, filed on Apr. 5, 2001, which are incorporated herein. As shown in FIGS. 9–13, the receptacle 330 includes a plurality of posts 332 forming a housing 334 for stacking a plurality of mediums 220. An elevator pin 336 is located beneath the conveyor belt surface to lift the mediums from the conveyor belt assembly 250 into the housing 334. The housing has a plurality of pawls 338 attached to the posts 332 to stack the mediums into the housing 334.

The operation of the receptacle 330 is controlled by a third sensor 244 located beneath the receptacle 330. The third sensor 244 is also able to detect the presence or absence of a medium 200 on the conveyor belt assembly 250 at the receptacle 330 and communicates with the microprocessor 218. If a medium 220 is present, the microprocessor 218 sends to a signal to a linkage assembly 350 attached to the elevator pin 336. The linkage assembly has a motor 352 and a set of gears 354 for lifting the elevator pin 336 from a first position 356 to a second position 358.

The third sensor 244 preferably is a proximity sensor having a light-emitting diode (LED) and a receptor. However, the third sensor 244 can also be an optical sensor, a micro-switch, a capacitive sensor, an induction sensor, a magnetic read switch or any other sensor known to one skilled in the art which recognizes the presence of the medium 220 on the conveyor belt surface 254.

In operation, as shown in FIGS. 13A–D, the elevator pin 336 presses the medium 220 upwards and the medium engages the stack 340 of mediums 220 from the bottom and presses into the stack 340. The medium 220 passes a hooked end 342 of the pawl 338 and once the medium 220 lifts above the hooked end 342 of the pawls 338, the pawls 338 drops downward into an extended configuration under the influence of gravity. The stack 340 of mediums 220 rest on the hooked ends 342 of the pawls 338. Although only a few mediums 220 are shown in the stack 340, the present invention is intended to lift a magnitude of mediums 220. The mediums 220 may include optical media, such as compact disks, CD-Rs, CD-RWs, digital video disks or digital versatile disks, computer chips, paper products, and paper like products.

the in-line marking system can be configured to be a stand-alone printer integrated into a reading and recording device, or combined with any other known marking device.

while the invention has been described in detail with reference to the preferred embodiments thereof, it will be apparent to one skilled in the art that various changes and modifications can be made and equivalents employed, without departing from the present invention.

What is claimed is:

1. An in-line marking system, the system comprising:

a dispenser for dispensing a markable medium;

a conveyor belt assembly for receiving the medium and conveying the medium from a first position to a second position, the conveyor belt assembly having a plurality of belts forming a substantially planar non-slip conveyor surface;

a marking device located between the first position and the second position for marking indicia on the medium; and a pad located between a first conveyor surface and a second conveyor surface, and a plurality of rollers for guiding the conveyor belt assembly around the pad.

2. The system according to claim 1, further comprising a housing having at least one hopper for stacking a plurality of mediums, wherein the dispenser is attached to the hopper for dispensing one medium at a time from the hopper.

3. The system according to claim 2, wherein the medium is a disk.

4. The system according to claim 1, further comprising at least one sensor for controlling the dispensing of the medium from the dispenser onto the conveyor surface.

5. The system according to claim 1, wherein the plurality of belts are rubber.

6. The system according to claim 1, further comprising at least one sensor for directing the marking of the medium.

7. The system according to claim 1, wherein the marking device is an ink jet printer.

8. The system according to claim 1, further comprising a receptacle for accepting the medium after marking.

9. The system according to claim 8, wherein the receptacle is a hopper with a spring loaded basket.

10. The system according to claim 1, wherein the medium is a digital medium.

11. The system according to claim 1, wherein the system is a stand-alone printer.

12. The system according to claim 1, wherein the system is integrated into a reading and recording device.

13. The system according to claim 1, wherein the plurality of belts have a diameter of approximately 1/16 of an inch to approximately 3/8 of an inch and a spacing between the plurality of belts of at least 1/2 inch.

14. The system according to claim 1, wherein the plurality of belts are not perforated.

15. The system according to claim 1, further comprising a receptacle having a plurality of posts forming a housing for stacking a plurality of disks and an elevator pin to lift the mediums from the conveyor belt assembly into the housing.

16. An in-line marking system, the system comprising:

a conveyor belt assembly for receiving a markable medium and conveying the medium from a first position to a second position, the conveyor belt assembly having a plurality of belts forming a substantially planar non-slip conveyor surface;

a marking device located between the first position and the second position for marking indicia on the medium received on the conveyor belt;

a pad located between a first conveyor surface and a second conveyor surface, and a plurality of rollers for guiding the conveyor belt assembly around the pad; and a receptacle for accepting the medium.

17. The system according to claim 16, further comprising a housing having at least one hopper for stacking a plurality of mediums, wherein a dispenser is attached to the hopper for dispensing a medium onto the conveyor surface.

18. The system according to claim 16, wherein the plurality of belts are not perforated.

19. A disk transfer system comprising:

a disk dispenser for dispensing disks;

a conveyor belt assembly for receiving a disk and passing the disk from a first position to a second position, the conveyor belt assembly having a plurality of belts forming a conveyor surface;

a marking device located between the first position and the second position for marking indicia on the disk; and a pad located between a first conveyor surface and a second conveyor surface, and a plurality of rollers for guiding the conveyor belt assembly around the pad.

20. The system according to claim 19, further comprising a housing having at least one hopper for stacking a plurality of disk, wherein the disk dispenser is attached to the hopper for dispensing a disk onto the conveyor surface.

21. The disk transfer system according to claim 19, wherein the belts have a diameter of about 1/16 of an inch to about 3/8 of an inch.

22. The system according to claim 19, wherein the marking device is an ink jet printer.

23. The system according to claim 19, wherein the marking device is a data writer.

24. The system according to claim 19, further comprising at least one sensor for controlling the dispensing of the disk from the dispenser onto the conveyor belt assembly.

25. The system according to claim 19, further comprising a receptacle for accepting the disk after marking.

26. The system according to claim 25, wherein the receptacle is a hopper with a spring loaded basket.

27. The system according to claim 19, further comprising at least one sensor for directing the marking of the disk.

28. The system according to claim 19, wherein the plurality of belts are not perforated.

29. An in-line marking system, the system comprising:

a dispenser for dispensing a markable medium;

a housing having at least one hopper for stacking a plurality of mediums, wherein the dispenser is attached to the hopper for dispensing one medium at a time from the hopper;

a conveyor belt assembly for receiving the medium and conveying the medium from a first position to a second position, the conveyor belt assembly having a plurality of belts forming a conveyor surface;

a marking device located between the first position and the second position for marking indicia on the medium;

a pad located between a first conveyor surface and a second conveyor surface, and a plurality of rollers for guiding the conveyor belt assembly around the pad; and at least one sensor for directing the marking of the medium.

30. The system according to claim 29, wherein the medium is a disk.

31. The system according to claim 29, further comprising at least one sensor for controlling the dispensing of the medium from the dispenser onto the conveyor surface.

32. The system according to claim 29, wherein the plurality of belts are rubber.

33. The system according to claim 29, wherein the marking device is an ink jet printer.

34. The system according to claim 29, further comprising a receptacle for accepting the medium after marking.

35. The system according to claim 29, wherein the receptacle is a hopper with a spring loaded basket.

36. The system according to claim 29, further comprising an elevator pin mounted beneath the conveyor belts, wherein the elevator pin stacks a plurality of disks into a hopper.

37. The system according to claim 29, wherein the medium is a digital medium.

38. The system according to claim 29, wherein the system is a stand-alone printer.

39. The system according to claim 29, wherein the system is integrated into a reading and recording device.

40. An in-line marking system, the system comprising:

a dispenser for dispensing a markable mediums;

a housing having at least one hopper for stacking a plurality of mediums, wherein the dispenser is attached to the hopper for dispensing one medium at a time from the hopper;

a substantially planar non-slip conveyor belt surface for receiving the medium and conveying the medium from a first position to a second position;

a marking device located between the first position and the second position for marking indicia on the medium;

a pad located between a first conveyor surface and a second conveyor surface, and a plurality of rollers for guiding the conveyor belt assembly around the pad; and a receptacle for accepting the medium after marking.

41. The system according to claim 40, wherein the medium is a disk.

42. The system according to claim 40, further comprising at least one sensor for controlling the dispensing of the medium from the dispenser onto the conveyor surface.

43. An in-line marking system comprising:

a dispenser for dispensing a markable medium;

a housing having at least one hopper for stacking a plurality of mediums, wherein the dispenser is attached to the hopper for dispensing one medium at a time from the hopper;

a conveyor belt surface for receiving the medium and conveying the medium from a first position to a second position;

a marking device located between the first position and the second position for marking indicia on the medium;

a receptacle for accepting the medium after marking; and a pad located between a first conveyor surface and a second conveyor surface, and a plurality of rollers for guiding the conveyor belt assembly around the pad.

* * * * *